US009988763B2

(12) United States Patent
Ramaratnam et al.

(10) Patent No.: US 9,988,763 B2
(45) Date of Patent: Jun. 5, 2018

(54) CANNABIS FIBER, ABSORBENT CELLULOSIC STRUCTURES CONTAINING CANNABIS FIBER AND METHODS OF MAKING THE SAME

(71) Applicant: FIRST QUALITY TISSUE, LLC, Great Neck, NY (US)

(72) Inventors: Karthik Ramaratnam, Anderson, SC (US); James E. Sealey, II, Belton, SC (US); Byrd Tyler Miller, IV, Easley, SC (US); Taras Z. Andrukh, Greenville, SC (US); Randy H. Elgin, Easley, SC (US)

(73) Assignee: FIRST QUALITY TISSUE, LLC, Great Neck, NY (US)

( * ) Notice: Subject to any disclaimer, the term of this patent is extended or adjusted under 35 U.S.C. 154(b) by 76 days.

(21) Appl. No.: 14/939,675

(22) Filed: Nov. 12, 2015

(65) Prior Publication Data

US 2016/0130762 A1 May 12, 2016

Related U.S. Application Data

(60) Provisional application No. 62/078,737, filed on Nov. 12, 2014.

(51) Int. Cl.
*D21H 17/24* (2006.01)
*D21H 11/12* (2006.01)
(Continued)

(52) U.S. Cl.
CPC ..... *D21H 17/24* (2013.01); *D21C 5/00* (2013.01); *D21C 9/10* (2013.01); *D21H 11/12* (2013.01); *D21H 27/002* (2013.01); *D21H 27/30* (2013.01)

(58) Field of Classification Search
CPC ..... D21H 27/30; D21H 27/02; D21H 11/08; D21H 11/10; D21H 11/12; D21H 17/02;
(Continued)

(56) References Cited

U.S. PATENT DOCUMENTS 2,919,467 A 1/1960 Mercer
2,926,154 A 2/1960 Keim
(Continued)

FOREIGN PATENT DOCUMENTS

CA 2168894 * 8/1997
CA 2168894 A1 8/1997
(Continued)

OTHER PUBLICATIONS

DE 4242539, Aug. 1993, English language machine translation [http://www.epo.org].*
(Continued)

*Primary Examiner* — Eric Hug
(74) *Attorney, Agent, or Firm* — Amster, Rothstein & Ebenstein LLP

(57) ABSTRACT

A method to prepare, pulp, and bleach *cannabis* bast and hurd fibers to allow for the fiber to be incorporated into absorbent cellulosic structures on a wet-laid paper machine while keeping the pectin within the fibers. The wet laid paper machine can use the ATMOS, NTT, ETAD, TAD, or UCTAD method to produce the absorbent cellulosic structure. Absorbent cellulosic structures are produced with the *cannabis* bast and hurd fibers or with the bast fibers alone with the hurd fibers being combined with paper mill sludge or dust to form a fuel pellet.

43 Claims, 10 Drawing Sheets

| | Cannabis Bast Fiber | Typical Softwood | Cannabis Hurd Fiber | Typical Hardwood |
|---|---|---|---|---|
| Fiber length | 2-90 mm | 2-7 mm | 1-2 mm | 1-3 mm |
| Fiber diameter | 16-50 um | 30-40 um | 10-25 um | 15-30 um |
| % Cellulose | 70-80% | 40-44% | 33-49% | 40-44% |
| % Hemicellulose | 12-25% | 20-32% | 16-23% | 15-35% |
| % lignin | 2-10% | 25-35% | 16-28% | 18-25% |

(51) Int. Cl.

| | |
|---|---|
| ***D21H 27/00*** | (2006.01) |
| ***D21H 27/30*** | (2006.01) |
| ***D21C 5/00*** | (2006.01) |
| ***D21C 9/10*** | (2006.01) |

(58) Field of Classification Search
CPC ..... D21H 17/23; D21H 17/24; D21H 27/00; D21H 27/38
USPC ..... 162/98, 129, 148, 150, 163
See application file for complete search history.

(56) References Cited

U.S. PATENT DOCUMENTS 3,026,231 A 3/1962 Chavannes
3,049,469 A 8/1962 Davison
3,058,873 A 10/1962 Keim et al.
3,066,066 A 11/1962 Keim et al.
3,097,994 A 7/1963 Dickens et al.
3,125,552 A 3/1964 Loshaek et al.
3,143,150 A 8/1964 Buchanan
3,186,900 A 6/1965 De Young
3,197,427 A 7/1965 Schmalz
3,224,986 A 12/1965 Butler et al.
3,224,990 A 12/1965 Babcock
3,227,615 A 1/1966 Korden
3,227,671 A 1/1966 Keim
3,239,491 A 3/1966 Tsou et al.
3,240,664 A 3/1966 Earle, Jr.
3,240,761 A 3/1966 Keim et al.
3,248,280 A 4/1966 Hyland, Jr.
3,250,664 A 5/1966 Conte et al.
3,252,181 A 5/1966 Hureau
3,301,746 A 1/1967 Sanford et al.
3,311,594 A 3/1967 Earle, Jr.
3,329,657 A 7/1967 Strazdins et al.
3,332,834 A 7/1967 Reynolds, Jr.
3,332,901 A 7/1967 Keim
3,352,833 A 11/1967 Earle, Jr.
3,384,692 A 5/1968 Galt et al.
3,414,459 A 12/1968 Wells
3,442,754 A 5/1969 Espy
3,459,697 A 8/1969 Goldberg et al.
3,473,576 A 10/1969 Amneus
3,483,077 A 12/1969 Aldrich
3,545,165 A 12/1970 Greenwell
3,556,932 A 1/1971 Coscia et al.
3,573,164 A 3/1971 Friedberg et al.
3,609,126 A 9/1971 Asao et al.
3,666,609 A 5/1972 Kalwaites et al.
3,672,949 A 6/1972 Brown
3,672,950 A 6/1972 Murphy et al.
3,773,290 A 11/1973 Mowery
3,778,339 A 12/1973 Williams et al.
3,813,362 A 5/1974 Coscia et al.
3,855,158 A 12/1974 Petrovich et al.
3,877,510 A 4/1975 Tegtmeier et al.
3,905,863 A 9/1975 Ayers
3,911,173 A 10/1975 Sprague, Jr.
3,974,025 A 8/1976 Ayers
3,994,771 A 11/1976 Morgan, Jr. et al.
3,998,690 A 12/1976 Lyness et al.
4,038,008 A 7/1977 Larsen
4,075,382 A 2/1978 Chapman et al.
4,088,528 A 5/1978 Berger et al.
4,098,632 A 7/1978 Sprague, Jr.
4,102,737 A 7/1978 Morton
4,129,528 A 12/1978 Petrovich et al.
4,147,586 A 4/1979 Petrovich et al.
4,184,519 A 1/1980 McDonald et al.
4,190,692 A 2/1980 Larsen
4,191,609 A 3/1980 Trokhan
4,252,761 A 2/1981 Schoggen et al.
4,320,162 A 3/1982 Schulz
4,331,510 A 5/1982 Wells
4,382,987 A 5/1983 Smart
4,440,597 A 4/1984 Wells et al.
4,501,862 A 2/1985 Keim
4,507,351 A 3/1985 Johnson et al.
4,514,345 A 4/1985 Johnson et al.
4,515,657 A 5/1985 Maslanka
4,528,239 A 7/1985 Trokhan
4,529,480 A 7/1985 Trokhan
4,537,657 A 8/1985 Keim
4,545,857 A 10/1985 Wells
4,637,859 A 1/1987 Trokhan
4,678,590 A 7/1987 Nakamura et al.
4,714,736 A 12/1987 Juhl et al.
4,770,920 A 9/1988 Larsonneur
4,780,357 A 10/1988 Akao
4,808,467 A 2/1989 Suskind et al.
4,836,894 A 6/1989 Chance et al.
4,849,054 A 7/1989 Klowak
4,885,202 A 12/1989 Lloyd et al.
4,891,249 A 1/1990 McIntyre
4,909,284 A 3/1990 Kositake
4,949,668 A 8/1990 Heindel et al.
4,949,688 A 8/1990 Bayless
4,983,256 A 1/1991 Combette et al.
4,996,091 A 2/1991 McIntyre
5,059,282 A 10/1991 Ampulski et al.
5,143,776 A 9/1992 Givens
5,149,401 A 9/1992 Langevin et al.
5,152,874 A 10/1992 Keller
5,211,813 A 5/1993 Sawley et al.
5,239,047 A 8/1993 Devore et al.
5,279,098 A 1/1994 Fukuda
5,281,306 A 1/1994 Kakiuchi et al.
5,334,289 A 8/1994 Trokhan et al.
5,347,795 A 9/1994 Fukuda
5,397,435 A 3/1995 Ostendorf et al.
5,399,412 A 3/1995 Sudall et al.
5,405,501 A 4/1995 Phan et al.
5,409,572 A 4/1995 Kershaw et al.
5,429,686 A 7/1995 Chid et al.
5,439,559 A 8/1995 Crouse
5,447,012 A 9/1995 Kovacs et al.
5,470,436 A 11/1995 Wagle et al.
5,487,313 A 1/1996 Johnson
5,509,913 A 4/1996 Yeo
5,510,002 A 4/1996 Hermans et al.
5,529,665 A 6/1996 Kaun
5,581,906 A 12/1996 Ensign et al.
5,591,147 A 1/1997 Couture-Dorschner et al.
5,607,551 A 3/1997 Farrington, Jr. et al.
5,611,890 A 3/1997 Vinson et al.
5,628,876 A 5/1997 Ayers et al.
5,635,028 A 6/1997 Vinson et al.
5,649,916 A 7/1997 Dipalma et al.
5,671,897 A 9/1997 Ogg et al.
5,672,248 A 9/1997 Wendt et al.
5,679,222 A 10/1997 Rasch et al.
5,685,428 A 11/1997 Herbers et al.
5,728,268 A 3/1998 Weisman et al.
5,746,887 A 5/1998 Wendt et al.
5,753,067 A 5/1998 Fukuda et al.
5,772,845 A 6/1998 Farrington, Jr. et al.
5,806,569 A 9/1998 Gulya et al.
5,827,384 A 10/1998 Canfield et al.
5,832,962 A 11/1998 Kaufman et al.
5,846,380 A 12/1998 Van Phan et al.
5,855,738 A 1/1999 Weisman et al.
5,858,554 A 1/1999 Neal et al.
5,865,396 A 2/1999 Ogg et al.
5,865,950 A 2/1999 Vinson et al.
5,893,965 A 4/1999 Trokhan et al.
5,913,765 A 6/1999 Burgess et al.
5,942,085 A 8/1999 Neal et al.
5,944,954 A 8/1999 Vinson et al.
5,948,210 A 9/1999 Huston
5,980,691 A 11/1999 Weisman et al.
6,036,139 A 3/2000 Ogg
6,039,838 A 3/2000 Kaufman et al.
6,048,938 A 4/2000 Neal et al.
6,060,149 A 5/2000 Nissing et al.

(56) References Cited

U.S. PATENT DOCUMENTS 6,106,670 A 8/2000 Weisman et al.
6,149,769 A 11/2000 Mohammadi et al.
6,162,327 A * 12/2000 Batra ..... B32B 29/06 162/109
6,162,329 A 12/2000 Vinson et al.
6,187,138 B1 2/2001 Neal et al.
6,200,419 B1 3/2001 Phan
6,203,667 B1 3/2001 Huhtelin
6,207,734 B1 3/2001 Vinson et al.
6,231,723 B1 5/2001 Kanitz et al.
6,287,426 B1 9/2001 Edwards et al.
6,303,233 B1 10/2001 Amon et al.
6,319,362 B1 11/2001 Huhtelin et al.
6,344,111 B1 2/2002 Wilhelm
6,420,013 B1 7/2002 Vinson et al.
6,420,100 B1 7/2002 Trokhan et al.
6,423,184 B2 7/2002 Vahatalo et al.
6,458,246 B1 10/2002 Kanitz et al.
6,464,831 B1 10/2002 Trokhan et al.
6,473,670 B1 10/2002 Huhtelin
6,521,089 B1 2/2003 Griech et al.
6,537,407 B1 3/2003 Law et al.
6,547,928 B2 4/2003 Barnholtz et al.
6,551,453 B2 4/2003 Weisman et al.
6,551,691 B1 4/2003 Hoeft et al.
6,572,722 B1 6/2003 Pratt
6,579,416 B1 6/2003 Vinson et al.
6,602,454 B2 8/2003 McGuire et al.
6,607,637 B1 8/2003 Vinson et al.
6,610,173 B1 8/2003 Lindsay et al.
6,613,194 B2 9/2003 Kanitz et al.
6,660,362 B1 9/2003 Lindsay et al.
6,673,202 B2 1/2004 Burazin
6,701,637 B2 5/2004 Lindsay et al.
6,755,939 B2 6/2004 Vinson et al.
6,773,647 B2 8/2004 McGuire et al.
6,797,117 B1 9/2004 McKay et al.
6,808,599 B2 10/2004 Burazin
6,821,386 B2 11/2004 Weisman et al.
6,821,391 B2 11/2004 Scherb et al.
6,827,818 B2 12/2004 Farrington, Jr. et al.
6,863,777 B2 3/2005 Kanitz et al.
6,896,767 B2 * 5/2005 Wilhelm ..... B31F 1/07 162/117
6,939,443 B2 9/2005 Ryan et al.
6,998,017 B2 2/2006 Lindsay et al.
6,998,024 B2 2/2006 Burazin
7,005,043 B2 2/2006 Toney et al.
7,014,735 B2 3/2006 Kramer et al.
7,105,465 B2 9/2006 Patel et al.
7,155,876 B2 1/2007 VanderTuin et al.
7,157,389 B2 1/2007 Branham et al.
7,182,837 B2 2/2007 Chen et al.
7,194,788 B2 3/2007 Clark et al.
7,235,156 B2 6/2007 Baggot
7,269,929 B2 9/2007 VanderTuin et al.
7,294,230 B2 11/2007 Flugge-Berendes et al.
7,311,853 B2 12/2007 Vinson et al.
7,328,550 B2 2/2008 Floding et al.
7,339,378 B2 3/2008 Han et al.
7,351,307 B2 4/2008 Scherb et al.
7,387,706 B2 6/2008 Herman et al.
7,399,378 B2 7/2008 Edwards et al.
7,419,569 B2 9/2008 Hermans
7,427,434 B2 9/2008 Busam
7,431,801 B2 10/2008 Conn et al.
7,432,309 B2 10/2008 Vinson
7,442,278 B2 10/2008 Murray et al.
7,452,447 B2 11/2008 Duan et al.
7,476,293 B2 1/2009 Herman et al.
7,494,563 B2 2/2009 Edwards et al.
7,510,631 B2 3/2009 Scherb et al.
7,513,975 B2 4/2009 Burma
7,563,344 B2 7/2009 Beuther
7,582,187 B2 9/2009 Scherb et al.
7,611,607 B2 11/2009 Mullally et al.
7,622,020 B2 11/2009 Awofeso
7,662,462 B2 2/2010 Noda
7,670,678 B2 3/2010 Phan
7,683,126 B2 3/2010 Neal et al.
7,686,923 B2 3/2010 Scherb et al.
7,687,140 B2 3/2010 Manifold et al.
7,691,230 B2 4/2010 Scherb et al.
7,744,722 B1 6/2010 Tucker et al.
7,744,726 B2 6/2010 Scherb et al.
7,799,382 B2 9/2010 Payne et al.
7,811,418 B2 10/2010 Klerelid et al.
7,815,978 B2 10/2010 Davenport et al.
7,823,366 B2 11/2010 Schoeneck
7,842,163 B2 11/2010 Nickel et al.
7,867,361 B2 1/2011 Salaam et al.
7,871,692 B2 1/2011 Morin et al.
7,887,673 B2 2/2011 Andersson et al.
7,905,989 B2 3/2011 Scherb et al.
7,914,866 B2 3/2011 Shannon et al.
7,931,781 B2 4/2011 Scherb et al.
7,951,269 B2 5/2011 Herman et al.
7,955,549 B2 6/2011 Noda
7,959,764 B2 6/2011 Ringer et al.
7,972,475 B2 7/2011 Chan et al.
7,989,058 B2 8/2011 Manifold et al.
8,034,463 B2 10/2011 Leimbach et al.
8,051,629 B2 11/2011 Pazdemik et al.
8,075,739 B2 12/2011 Scherb et al.
8,092,652 B2 1/2012 Scherb et al.
8,118,979 B2 2/2012 Herman et al.
8,147,649 B1 4/2012 Tucker et al.
8,152,959 B2 4/2012 Elony et al.
8,196,314 B2 6/2012 Munch
8,216,427 B2 7/2012 Klerelid et al.
8,236,135 B2 8/2012 Prodoehl et al.
8,303,773 B2 11/2012 Scherb et al.
8,382,956 B2 2/2013 Boechat et al.
8,402,673 B2 3/2013 Da Silva et al.
8,409,404 B2 4/2013 Harper et al.
8,435,384 B2 5/2013 Da Silva et al.
8,440,055 B2 5/2013 Scherb et al.
8,445,032 B2 5/2013 Topolkaraev et al.
8,454,800 B2 6/2013 Mourad et al.
8,470,133 B2 6/2013 Cunnane et al.
8,506,756 B2 8/2013 Denis et al.
8,544,184 B2 10/2013 Da Silva et al.
8,574,211 B2 11/2013 Morita
8,580,083 B2 11/2013 Boechat et al.
8,728,277 B2 5/2014 Boechat et al.
8,758,569 B2 6/2014 Aberg et al.
8,771,466 B2 7/2014 Denis et al.
8,801,903 B2 8/2014 Mourad et al.
8,815,057 B2 8/2014 Eberhardt et al.
8,822,009 B2 9/2014 Riviere et al.
8,968,517 B2 3/2015 Ramaratnam et al.
8,980,062 B2 3/2015 Karlsson et al.
9,005,710 B2 4/2015 Jones et al.
D734,617 S 7/2015 Seitzinger et al.
9,095,477 B2 8/2015 Yamaguchi
D738,633 S 9/2015 Seitzinger et al.
9,382,666 B2 7/2016 Ramaratnam et al.
9,506,203 B2 11/2016 Ramaratnam et al.
9,580,872 B2 2/2017 Ramaratnam et al.
9,702,089 B2 7/2017 Ramaratnam et al.
9,702,090 B2 7/2017 Ramaratnam et al.
9,719,213 B2 8/2017 Miller, IV et al.
9,725,853 B2 8/2017 Ramaratnam et al.
2001/0018068 A1 8/2001 Lorenzi et al.
2002/0028230 A1 3/2002 Eichhorn et al.
2002/0060049 A1 5/2002 Kanitz et al.
2002/0061386 A1 5/2002 Carson et al.
2002/0098317 A1 7/2002 Jaschinski et al.
2002/0110655 A1 8/2002 Seth
2002/0115194 A1 8/2002 Lange et al.
2002/0125606 A1 9/2002 McGuire et al.
2003/0024674 A1 2/2003 Kanitz et al.
2003/0056911 A1 3/2003 Hermans et al.
2003/0056917 A1 3/2003 Jimenez

(56) References Cited

U.S. PATENT DOCUMENTS

2003/0070781 A1 4/2003 Hermans et al.
2003/0114071 A1 6/2003 Everhart et al.
2003/0159401 A1 8/2003 Sorensson et al.
2003/0188843 A1 10/2003 Kanitz et al.
2003/0218274 A1 11/2003 Boutilier et al.
2004/0118531 A1 6/2004 Shannon et al.
2004/0123963 A1 7/2004 Chen et al.
2004/0126601 A1 7/2004 Kramer et al.
2004/0126710 A1 7/2004 Hill et al.
2004/0168784 A1 9/2004 Duan et al.
2004/0173333 A1 9/2004 Hermans et al.
2004/0234804 A1 11/2004 Liu et al.
2005/0016704 A1 1/2005 Huhtelin
2005/0069679 A1 3/2005 Stelljes et al.
2005/0069680 A1 3/2005 Stelljes et al.
2005/0098281 A1 5/2005 Schulz et al.
2005/0112115 A1 5/2005 Khan
2005/0123726 A1 6/2005 Broering et al.
2005/0130536 A1 6/2005 Siebers et al.
2005/0136222 A1* 6/2005 Hada ..... D21F 11/006 428/156
2005/0148257 A1 7/2005 Hermans et al.
2005/0150626 A1 7/2005 Kanitz et al.
2005/0166551 A1 8/2005 Keane et al.
2005/0241786 A1 11/2005 Edwards et al.
2005/0241788 A1 11/2005 Baggot et al.
2005/0252626 A1 11/2005 Chen et al.
2005/0280184 A1 12/2005 Sayers et al.
2005/0287340 A1 12/2005 Morelli et al.
2006/0005916 A1 1/2006 Stelljes et al.
2006/0013998 A1 1/2006 Stelljes et al.
2006/0019567 A1 1/2006 Sayers
2006/0083899 A1* 4/2006 Burazin ..... D21H 27/002 428/174
2006/0093788 A1 5/2006 Behm et al.
2006/0113049 A1 6/2006 Knobloch et al.
2006/0130986 A1 6/2006 Flugge-Berendes et al.
2006/0194022 A1 8/2006 Boutilier et al.
2006/0269706 A1 11/2006 Shannon et al.
2007/0020315 A1 1/2007 Shannon et al.
2007/0131366 A1* 6/2007 Underhill ..... D21F 11/14 162/109
2007/0137813 A1 6/2007 Nickel et al.
2007/0137814 A1 6/2007 Gao
2007/0170610 A1 7/2007 Payne et al.
2007/0240842 A1 10/2007 Scherb et al.
2007/0251659 A1 11/2007 Fernandes et al.
2007/0251660 A1 11/2007 Walkenhaus et al.
2007/0267157 A1 11/2007 Kanitz et al.
2007/0272381 A1 11/2007 Elony et al.
2007/0275866 A1 11/2007 Dykstra
2007/0298221 A1 12/2007 Vinson
2008/0035289 A1 2/2008 Edwards et al.
2008/0076695 A1 3/2008 Uitenbroek et al.
2008/0156450 A1 7/2008 Klerelid et al.
2008/0199655 A1 8/2008 Monnerie et al.
2008/0245498 A1 10/2008 Ostendorf et al.
2008/0302493 A1 12/2008 Boatman et al.
2008/0308247 A1 12/2008 Ringer et al.
2009/0020248 A1 1/2009 Sumnicht et al.
2009/0056892 A1 3/2009 Rekoske
2009/0061709 A1 3/2009 Nakai et al.
2009/0205797 A1 8/2009 Fernandes et al.
2009/0218056 A1* 9/2009 Manifold ..... D21H 27/005 162/109
2010/0065234 A1 3/2010 Klerelid et al.
2010/0119779 A1 5/2010 Ostendorf et al.
2010/0224338 A1 9/2010 Harper et al.
2010/0230064 A1 9/2010 Eagles et al.
2010/0236034 A1 9/2010 Eagles et al.
2010/0239825 A1 9/2010 Sheehan et al.
2010/0272965 A1 10/2010 Schinkoreit et al.
2011/0027545 A1 2/2011 Harlacher et al.
2011/0180223 A1* 7/2011 Klerelid ..... D21F 11/006 162/111
2011/0189435 A1* 8/2011 Manifold ..... D21H 27/002 428/156
2011/0189442 A1* 8/2011 Manifold ..... D21H 27/002 428/174
2011/0206913 A1 8/2011 Manifold et al.
2011/0223381 A1 9/2011 Sauter et al.
2011/0253329 A1 10/2011 Manifold et al.
2011/0265967 A1 11/2011 Van Phan
2011/0303379 A1 12/2011 Boechat et al.
2012/0144611 A1 6/2012 Baker et al.
2012/0152475 A1 6/2012 Edwards et al.
2012/0177888 A1 7/2012 Escafere et al.
2012/0244241 A1 9/2012 McNeil
2012/0267063 A1 10/2012 Klerelid et al.
2012/0297560 A1 11/2012 Zwick et al.
2013/0008135 A1 1/2013 Moore et al.
2013/0029105 A1 1/2013 Miller et al.
2013/0029106 A1 1/2013 Lee et al.
2013/0133851 A1 5/2013 Boechat et al.
2013/0150817 A1 6/2013 Kainth et al.
2013/0160960 A1 6/2013 Hermans et al.
2013/0209749 A1 8/2013 Myangiro et al.
2013/0248129 A1 9/2013 Manifold et al.
2013/0327487 A1 12/2013 Espinosa et al.
2014/0004307 A1 1/2014 Sheehan
2014/0041820 A1* 2/2014 Ramaratnam ..... D21H 27/008 162/127
2014/0041822 A1 2/2014 Boechat et al.
2014/0050890 A1 2/2014 Zwick et al.
2014/0053994 A1 2/2014 Manifold et al.
2014/0096924 A1* 4/2014 Rekoske ..... D21H 27/002 162/111
2014/0182798 A1 7/2014 Polat et al.
2014/0242320 A1 8/2014 McNeil et al.
2014/0272269 A1 9/2014 Hansen
2014/0272747 A1 9/2014 Ciurkot
2014/0284237 A1 9/2014 Gosset
2014/0360519 A1* 12/2014 George ..... A24D 1/02 131/365
2015/0059995 A1 3/2015 Ramaratnam et al.
2015/0102526 A1 4/2015 Ward et al.
2015/0129145 A1 5/2015 Chou et al.
2015/0211179 A1 7/2015 Alias et al.
2015/0241788 A1 8/2015 Yamaguchi
2015/0330029 A1 11/2015 Ramaratnam et al.
2016/0060811 A1 3/2016 Riding et al.
2016/0090692 A1 3/2016 Eagles et al.
2016/0090693 A1 3/2016 Eagles et al.
2016/0145810 A1 5/2016 Miller, IV et al.
2016/0159007 A1 6/2016 Miller, IV et al.
2016/0160448 A1 6/2016 Miller, IV et al.
2016/0185041 A1 6/2016 Topolkaraev et al.
2016/0185050 A1 6/2016 Topolkaraev et al.
2016/0273168 A1 9/2016 Ramaratnam et al.
2016/0273169 A1 9/2016 Ramaratnam et al.
2016/0289897 A1 10/2016 Ramaratnam et al.
2016/0289898 A1 10/2016 Ramaratnam et al.
2017/0044717 A1 2/2017 Quigley
2017/0101741 A1 4/2017 Sealey et al.
2017/0167082 A1 6/2017 Ramaratnam et al.
2017/0226698 A1 8/2017 LeBrun et al.
2017/0233946 A1 8/2017 Sealey et al.
2017/0253422 A1 9/2017 Anklam et al.
2017/0268178 A1 9/2017 Ramaratnam et al.

FOREIGN PATENT DOCUMENTS

CA 2795139 A1 10/2011
CN 1138356 A 12/1996
CN 1207149 A 2/1999
CN 1244899 A 2/2000
CN 1268559 A 10/2000
CN 1377405 A 10/2002
CN 2728254 Y 9/2005
DE 4242539 * 8/1993
EP 0097036 A2 12/1983

(56) References Cited

FOREIGN PATENT DOCUMENTS

| | | | |
|---|---|---|---|
| EP | 0979895 | A1 | 2/2000 |
| EP | 1911574 | A1 | 1/2007 |
| EP | 1339915 | B1 | 7/2007 |
| EP | 2123826 | A2 | 5/2009 |
| GB | 946093 | A | 1/1964 |
| JP | 2013208298 | A | 10/2013 |
| JP | 2014213138 | A | 11/2014 |
| WO | 96/06223 | A1 | 2/1996 |
| WO | 03082550 | A2 | 10/2003 |
| WO | 2004045834 | A1 | 6/2004 |
| WO | 2007070145 | A1 | 6/2007 |
| WO | 2008019702 | A1 | 2/2008 |
| WO | 2009006709 | A1 | 1/2009 |
| WO | 2009/061079 | A1 | 5/2009 |
| WO | 2009067079 | A1 | 5/2009 |
| WO | 2011028823 | A1 | 3/2011 |
| WO | 2012003360 | A2 | 1/2012 |
| WO | 2013024297 | A1 | 2/2013 |
| WO | 2013/136471 | A1 | 9/2013 |
| WO | 2014/022848 | A1 | 2/2014 |
| WO | 2015000755 | A1 | 1/2015 |
| WO | 2015/176063 | A1 | 11/2015 |
| WO | 2016/077594 | A1 | 5/2016 |
| WO | 2016/086019 | A1 | 6/2016 |
| WO | 2016/090242 | A1 | 6/2016 |
| WO | 2016/090364 | A1 | 6/2016 |
| WO | 2016085704 | A1 | 6/2016 |
| WO | 2017066465 | A1 | 4/2017 |
| WO | 2017066656 | A1 | 4/2017 |
| WO | 2017139786 | A1 | 8/2017 |

OTHER PUBLICATIONS

International Search Report of PCT/US15/60398 dated Jan. 29, 2016.
Written Opinion of PCT/US15/60398 dated Jan. 29, 2016.
International Preliminary Report on Patentability of PCT/US2013/053593 dated Feb. 3, 2015.
Supplementary European Search Report of EP 13 82 6461 dated Apr. 1, 2016.
Written Opinion of International Searching Authority for PCT/US15/62483 dated May 6, 2016.
International Search Report for PCT/US15/63986 dated Mar. 29, 2016.
Written Opinion of International Searching Authority for PCT/US15/63986 dated Mar. 29, 2016.
International Search Report for PCT/US15/64284 dated Feb. 11, 2016.
Written Opinion of International Searching Authority for PCT/US15/64284 dated Feb. 11, 2016.
International Search Report for PCT/US13/53593 dated Dec. 30, 2013.
Written Opinion of International Searching Authority for PCT/US13/53593 dated Dec. 30, 2013.
International Search Report for PCT/US15/31411 dated Aug. 13, 2015.
Written Opinion of International Searching Authority for PCT/US15/31411 dated Aug. 13, 2015.
International Search Report for PCT/US15/62483 dated May 6, 2016.
International Search Report for PCT/US16/56871 dated Jan. 12, 2017.
Written Opinion of International Searching Authority for PCT/US16/56871 dated Jan. 12, 2017.
International Search Report for PCT/US2016/057163 dated Dec. 23, 2016.
Written Opinion of International Searching Authority for PCT/US2016/057163 dated Dec. 23, 2016.
International Search Report for PCT/US2017/029890 dated Jul. 14, 2017.
Written Opinion of International Searching Authority for PCT/US2017/029890 dated Jul. 14, 2017.
International Search Report for PCT/US2017/032746 dated Aug. 7, 2017.
Written Opinion of International Searching Authority for PCT/US2017/032746 dated Aug. 7, 2017.
International Search Report for PCT/US17/17705 dated Jun. 9, 2017.
Written Opinion of International Searching Authority for PCT/US17/17705 dated Jun. 9, 2017.

* cited by examiner

| | Cannabis Bast Fiber | Typical Softwood | Cannabis Hurd Fiber | Typical Hardwood |
|---|---|---|---|---|
| Fiber length | 2-90 mm | 2-7 mm | 1-2 mm | 1-3 mm |
| Fiber diameter | 16-50 um | 30-40 um | 10-25 um | 15-30 um |
| % Cellulose | 70-80% | 40-44% | 33-49% | 40-44% |
| % Hemicellulose | 12-25% | 20-32% | 16-23% | 15-35% |
| % lignin | 2-10% | 25-35% | 16-28% | 18-25% |

Figure 8

| Overview | Instructions & Explanations |
|---|---|
| Step 1: Test Equipment Preparation | Ensure all tools & materials are available . |
| Step 2: Sample Preparation | From a cut roll, pull off 3 tissue sample, 2 sheets long<br>Fold in half at perf with embossed side up.<br>Place folded sample on top of cardboard with MD direction parallel with length of board.<br>Flip over sample and cardboard<br>Fold over cut edges<br>Tape securely around cardboard so sample does not move during test<br>Repeat steps 2.2 through 2.5 for the remaining 2 samples |
| Step 3: Loading tissue sample on tester | Place 1 cardboard with tissue sample on the lint tester sample deck<br>Line cardboard up with the rubber padding underneath<br>Lock down each end. |
| Step 4: Measuring Felt ***L*** (Before) Value | If clean felt has been pre-measured for ***L*** value , skip to step 5.<br>Determine the fuzziest side of 3 felt samples by holding the felt up and looking across the top and bottom at the same time.<br>On a ColorTouch2, manufactured by Technidyne Corporation, of New Albany, IN, USA, place felt, fuzzy side up, on the plunger.<br>Press ***Lint*** under ***AutoMeasure,*** then ***Enter,*** then ***Measure***<br>Write the date and ***L*** value on small sticker and place on end of felt strip<br>Store premeasured felt strips in a reclosable plastic bag out of the light |
| Step 5: Felt Preparation for test | Pull 3 pre-measured felt strips from plastic bag<br>Enter the 3 ***L*** value results on TSE-QA-FO-053 under ***L (Before)***<br>Lay felt, fuzzy side up, on pre-scored cardboard.<br>Fold ~1/4" of felt around end of cardboard and tuck inside clip of 4lb weight.<br>Slightly pull felt to fold ~1/4" of felt around the opposite end and tuck in clip to secure<br>Attach weight with felt onto the Sutherland 2000 at the hinge<br>Gently press the right side of the weight so the felt is lying flat and even on the test sample. |
| Step 6: Sutherland 2000 Set up | If the Sutherland 2000 is in Sleep Mode, click the START/STOP button to turn machine on.<br>Set the Count to 5 and Speed to SPEED 2<br>Press the START/STOP button to start test<br>When the machine stops, gently remove the 4 lb. weight with felt by lifting straight up<br>Do not brush across the tissue sample<br>Carefully remove the felt/cardboard from weight<br>Identify sample as 1, 2 or 3 to correspond with its ***L*** **(Before)** value<br>Lay felt aside and cover with a clean white sheet of paper<br>Dispose of tissue sample in trash can - not Broke - due to possible tape contamination<br>Repeat steps 3 through 6 for the remaining two samples |
| Step 7: Reading Test Results | Place the 3 separated felt samples inside a re-closable plastic bag.<br>Take samples to the ColorTouch 2<br>On the ColorTouch 2, place felt, lint side up, on the plunger<br>Press ***Lint*** under ***AutoMeasure,*** then ***Enter,*** then ***Measure***<br>Write the ***L*** value under results on TSE-QA-FO-053 under ***L (After)***<br>Subtract the ***L (Before)*** from ***L (After)*** and enter results on form<br>When reading is completed, dispose of felt samples in the trash can. **Do not re-use.**<br>Repeat step 7 for the remaining 2 samples |

Figure 9

CANNABIS FIBER, ABSORBENT CELLULOSIC STRUCTURES CONTAINING CANNABIS FIBER AND METHODS OF MAKING THE SAME

RELATED APPLICATION

This application is a non-provisional based on U.S. Provisional Patent Application No. 62/078,737, filed Nov. 12, 2014, the contents of which are incorporated herein by reference in their entirety.

FIELD OF THE INVENTION

The present disclosure relates to absorbent cellulosic structures manufactured using *cannabis* fibers containing pectin.

BACKGROUND

*Cannabis* is a genus of flowering plants that includes three different species, *Cannabis sativa, Cannabis indica*, and *Cannabis ruderalis*. *Cannabis* has long been used for fiber (hemp), for seed and seed oils, and recently for medicinal purposes. In the mid-1930's, the growth of *cannabis* plants was outlawed in most countries due to its usage as a recreational psychoactive drug. In the 1970's, the ability to test and breed plants to contain low levels of the psychoactive drug, tetra-hydro-cannabinol (THC), became possible. Since this time, many countries have legalized the cultivation of *cannabis* plants that contain low THC content (0.3% or below). Unfortunately; during the period of prohibition; cultivation knowledge, processing equipment, and expertise had been optimized for other natural fibers, such as cotton, and synthetic polymer fibers, resulting in hemp not being economically viable.

Today, the growth and use of *cannabis* is extremely small and relegated to production of the seed for sale to the food industry. Recently, the growth of *cannabis* for use in the pharmaceutical industry has begun. Although not economically feasible to grow solely as a fiber source, the *cannabis* stalk (which is the fiber source) is a waste product when grown for the seed or for the compounds used by the pharmaceutical industry. Therefore, *cannabis* can be economically competitive as a fiber source when the stalks are harvested as a waste product from these industries.

The *cannabis* stalk (or stem) consists of an open cavity surrounded by an inner layer of core fiber, often referred to as hurd, and an outer layer referred to as the bast. Bast fibers are roughly 20% of the stalk mass and the hurd 80% of the mass. The primary bast fiber is attached to the hurd fiber by pectin, a glue like substance. *Cannabis* bast fibers have a large range in length and diameter, but on average are very long with medium coarseness; suitable for making textiles, paper, and nonwovens. The hurd consists of very short, bulky fibers, typically 0.2-0.65 mm in length.

*Cannabis* fibers are hydrophobic by nature. In order for them to be used for paper products, the fibers need to be liberated, typically by oxidation, in order to make them hydrophilic and suitable for use in fabricating paper using a wet laid process. In conventional *cannabis* fiber preparation, the *cannabis* fibers are pulped and bleached to remove the bound lignin and pectin and further separate the fiber bundles that still exist after decortication, the mechanical separation of the fibers in the *cannabis* stalk.

Conventionally, the pulping of *cannabis* is usually an alkaline process where the fibers are added to a digester under elevated temperature and pressure with caustic chemicals (e.g., sodium hydroxide and sodium sulfate) until all fibers are separated from each other. Washing with excess water removes the chemicals and the extracted binding components. The conventional pulping process removes the pectin from the *cannabis* fibers and requires a substantial amount of water when the fibers are added to the digester.

SUMMARY OF THE INVENTION

An object of the present invention is to provide a method of manufacturing absorbent cellulosic structures using *cannabis* fibers in which the *cannabis* fibers are oxidized while leaving a substantial amount of the pectin intact and using less water than the conventional pulping process. In an exemplary embodiment, at least 50% by weight of the amount of original pectin is left intact and the fibers are liberalized using at least 15 liters of water/kg of fiber less than conventional pulping methods.

Another object of the present invention is to provide a use for *cannabis* hurd fibers when only bast fibers are used for the manufacture of paper products.

According to an exemplary embodiment of the invention, Northern Bleached Softwood Kraft pulp is replaced wholly or in part with *cannabis* bast fiber and *eucalyptus* fiber to lower the manufacturing cost of absorbent cellulosic structures. In accordance with the invention, the *cannabis* bast fibers are prepared, pulped, and bleached to allow for the fiber to be incorporated into absorbent cellulosic structures on a wet-laid asset while retaining all or a substantial amount of the pectin with the bast fiber. The wet laid asset can be a tissue machine for making towel, bath tissue or facial tissue. The tissue machine may use through air drying (TAD), or other drying technologies such as dry creping, Structured Tissue Technology (STT), Advantage NTT, equivalent TAD paper (ETAD), uncreped through air drying (UCTAD) or Advanced Tissue Molding System (ATMOS), to name a few, to produce the absorbent cellulosic structure.

The absorbent cellulosic structures of the invention have a low basis weight and high pectin concentration and have equal absorbency, strength, and softness compared to absorbent cellulosic structures of higher basis weight.

Hurd fibers can be prepared together with bast fibers into absorbent cellulosic structures in a similar fashion. Alternatively, when the hurd fibers are not included in the wet laid asset, they can be diverted from the decortification facility and combined with paper mill sludge or dust to form a novel fuel pellet composed of the *cannabis* hurd fibers and wood fiber, derived from the paper mill sludge or dust.

BRIEF DESCRIPTION OF THE DRAWINGS

The features and advantages of exemplary embodiments of the present invention will be more fully understood with reference to the following, detailed description when taken in conjunction with the accompanying figures, wherein:

FIG. 8 illustrates *cannabis* bast and hurd fiber properties as compared to typical softwood and hardwood fibers.

FIG. 9 illustrates the steps required for the lint testing procedure.

DETAILED DESCRIPTION

Figure 1:
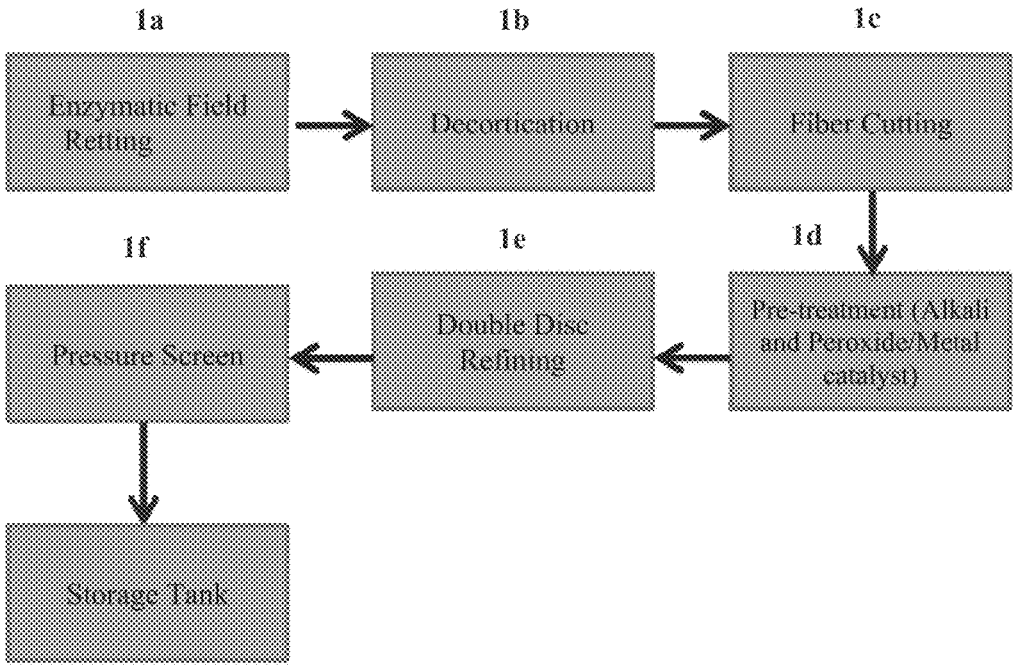
FIG. 1 illustrates *cannabis* fiber processing via enzymatic field retting and refining with alkali, peroxide and catalyst pre-treatment according to an exemplary embodiment of the present invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

The present invention is directed to the use of *cannabis* fibers in the base sheet of absorbent products, such as tissue or towel products. Such tissue and towel products may be formed using the systems and methods described in U.S. application Ser. No. 13/837,685 (issued as U.S. Pat. No. 8,968,517); Ser. No. 14/534,631; and Ser. No. 14/561,802, the contents of which are incorporated herein by reference in their entirety.

The first step to obtain suitable fibers from the *cannabis* stalk for use in absorbent cellulosic structures such as paper towel, bath, facial tissue, or nonwoven products is enzymatic field retting, as shown in FIGS. 1-4. This involves letting cut *cannabis* plants sit in the field with applied enzymes to degrade components that hold the hurd and bast fibers together in the *cannabis* stalk. This process improves the ability to separate the fibers in the decortication process. The components upon which the enzymes act to cleave molecular bonds are lignin, pectins and extractives. The enzyme solution is engineered to be void of pectinase or other enzymatic components that preferentially attack pectins, thereby increasing fiber yield through this isolation process. Enzymes such as laccase, xylanases, and lignase are preferred so as to minimize any unwanted degradation of the fiber cellulose and hemicellulose while keeping the pectin intact. This enzymatic retting process is carried out under controlled conditions based on the type of enzyme, including control of time, temperature and enzyme concentration to maximize fiber yield and fiber physical properties such as strength.

Next is a decortication stage, shown in FIGS. 1-7, wherein the bast fiber is removed from the woody hurd core using a series of steps. Some of these steps involve chopping the fiber/woody core to smaller lengths, passing the material through one or more hammer mills to separate bast fiber from the woody core followed by several screens to maximize fiber separation from the woody core.

Next is a fiber cutting stage, shown in FIGS. 1-6. During this stage, the bast and hurd fibers are each separately cut to a length preferably 12 mm or less. The length is critical to ensure that the fiber does not fold upon itself or fold around other fiber to create a fiber bundles that can plug processing equipment on the wet laid asset. In this process the fibers are cut to the 0.5 to 20 mm range, preferably to the 3 to 8 mm range, and more preferably to 6 mm. FIG. 8 illustrates typical properties for the *cannabis* hurd and bast fibers as compared to typical softwood and hardwood fibers.

After the fiber bundles are cut to length, the bast fibers are added alone or in combination with the hurd fibers to a hydro-pulper with hot water (50-212° F., preferably 120-190° F.) at a consistency between 0.5 to 30%, preferably between 3 to 6%, and beaten for 20-40 minutes.

Figure 4:
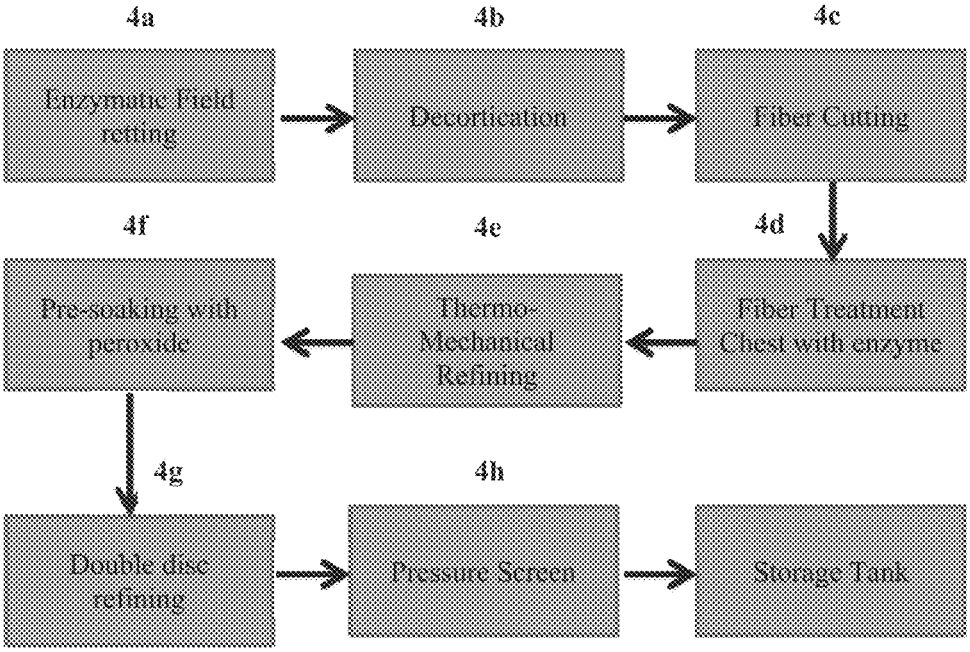
FIG. 4 illustrates *cannabis* fiber processing via enzymatic field retting and two stage refining in the presence of peroxide and steam, including enzymatic pre-treatment according to an exemplary embodiment of the present invention.
Figure 5:
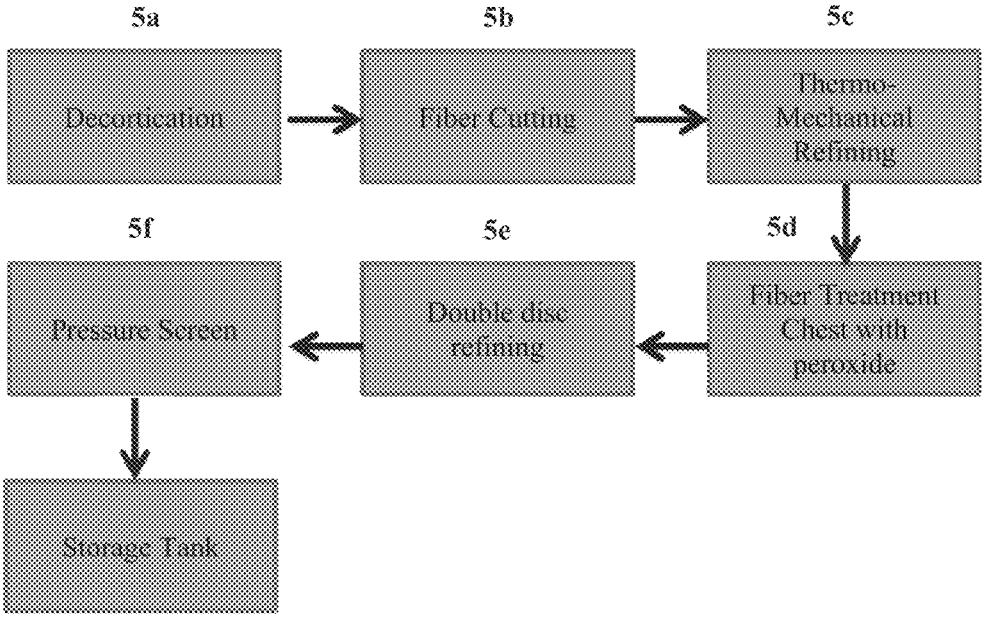
FIG. 5 illustrates *cannabis* fiber processing via two stage refining in the presence of peroxide and steam according to an exemplary embodiment of the present invention.
Figure 6:
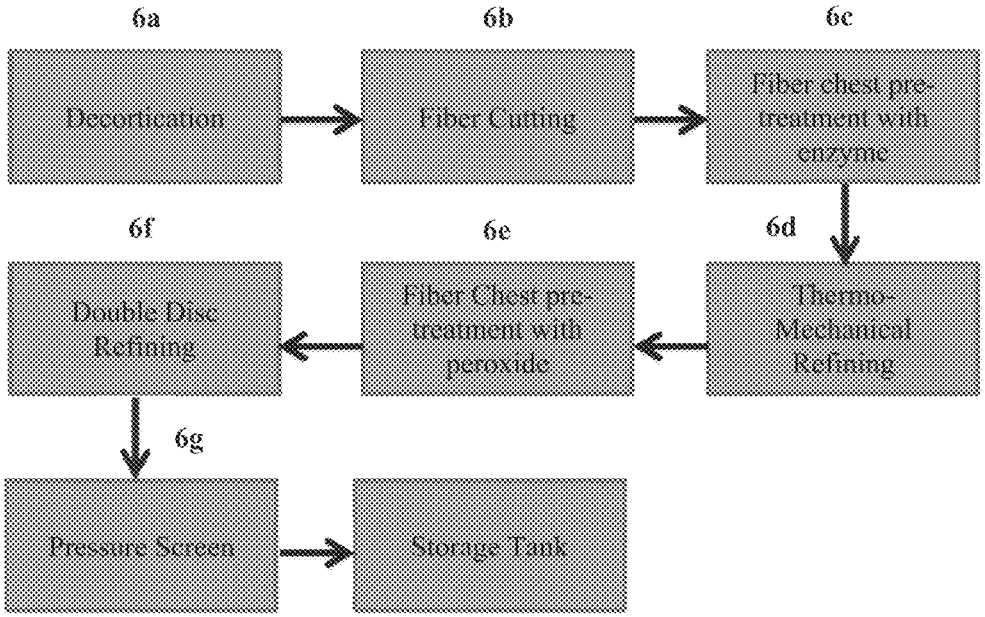
FIG. 6 illustrates *cannabis* fiber processing via two stage refining in the presence of peroxide and steam, including enzymatic pre-treatment according to an exemplary embodiment of the present invention.

After beating, the fibers are pumped to a storage chest, as shown in FIGS. 4-6, and then to a mechanical refiner at a controlled consistency between 2-3%. The fibers may be pumped separately, together, or co-mixed with other wood, plant or synthetic based fibers. The storage chest includes steam injection and agitation to maintain the temperature set-point between 50-212° F. The mechanical refiner can be a disk or conical refiner with plates preferably designed for medium intensity refining.

In the case of a two stage refining process, the fibers will go through a thermo-mechanical refining (TMP) and double disc refiner, as shown in FIGS. 4-6. The mechanical refiner can be a disk or conical refiner with plates preferably designed for medium intensity refining. TMP process involves refining under high temperature and pressure with steam pressure in the range of 2 to 12 bars, preferably between 8 to 10 bars. The additional step of TMP process further aids the lignin removal with limited pectin removal from the fiber, providing uniform fibers for paper and non-woven use.

The preferred energy intensity imparted to the fiber from the refiner should be 40 to 120 kwh/ton such that the fiber bundles are mostly separated into individual fibers.

In the final step, shown in FIGS. 1-6, the refined fibers will go through a pressure screen to remove unprocessed fibers with some moderate washing to remove any unoxidized lignin and/or small amounts of pectins that may have separated from the previous processing steps.

During the fiber preparation process, the fibers must be liberated, in this case through oxidation, in order for the fibers to become hydrophilic so that they may be used in absorbent cellulosic structures. Oxidation of the phenolic material into muconic acids and other carboxylic acid structures in the bound lignin, pectin, and hemicellulose will occur inside the refiner to hydrophilize the fiber surface. The bast and hurd fiber are preferably processed separately through the refiner, but can optionally be co-refined together, or with other wood, plant or synthetic fibers using the process just described.

This process may involve either alkali/enzyme, or peroxide pretreatment as shown in FIGS. 1 through 6 and takes place either in an air stream prior to the hydropulping step described above, or after the hydropulping but before the refining step described above.

This process is a water-efficient method of liberalizing the fibers using at least 15 liters of water/kg of fiber less than conventional pulping methods. The material to liquid ratio in this approach is in the range of 1:1 to 1:10 compared to a material to liquid range of 1:25 to 1:50 in conventional pulping.

For alkali treatment, the fibers will be treated with sodium hydroxide or sodium carbonate at 1 to 10% by weight concentrations on the weight of fibers. For enzymatic treatment, laccase, xylanase and lignase may be used separately or in combination to degum the fibrous materials.

In case of peroxide treatment, hydrogen peroxide or peracetate or ozone may be used in presence of transition metal ions some of which may include scandium, titanium, vanadium, chromium, manganese, iron, cobalt, nickel, copper, zinc, yittrium, zirconium, molybdenum, rhodium, palladium, silver, cadmium, platinum, gold, mercury, etc. The transition metal ions may be added to the hydrogen peroxide at a ratio between 1000 parts hydrogen peroxide to 1 part catalyst to 10 parts hydrogen peroxide to 1 part catalyst.

Peroxide treatment is carried out in alkaline conditions in the presence of sodium hydroxide and/or sodium carbonate. Use of hydrogen peroxide under these conditions may promote catalytic cleavage due to the instability of hydrogen peroxide under these conditions. Also some of the lignin compounds may be broken down via catalytic cleavage and further oxidation. Hydrogen peroxide addition rates may range from 0.25% by weight of fiber to 5% by weight of fiber. Hydrogen peroxide usage may be monitored using an Oxidation Reduction Potential (ORP) meter. The ORP meter target may range from +350 to +500 mV at the injection point of $H_2O_2$, preferably between +350 and +450 mV, before refining and between +100 to +200 mV after refining to ensure depletion of peroxide activity.

In the case of sodium hydroxide addition, base may be controlled using an online pH probe, connected to piping after the discharge of the refiner, to a pH set-point between 7 and 12, preferably between 7 and 10, more preferably between 7 and 9.

Alternatively, the peroxide treatment may be carried out under acid conditions. In that case, hydrogen peroxide mixed with a metal catalyst such as copper (1 part catalyst to 100 parts hydrogen peroxide) is added after urea sulfate addition near the inlet to the refiner where the oxidation reduction potential of the fiber slurry prior to the mechanical refiner is controlled to between +300 and +500 mV, preferably between +350 and +450 mV, or where the oxidation reduction potential of the fiber slurry after the mechanical refiner is controlled to between −100 mV and −200 mV.

In the case where acid is used the acid may be controlled using an online pH probe, connected to piping after the discharge of the refiner, to a pH set-point between 4 and 7 in the case and preferably between 4 and 7.

The oxidized fibers are then blended with other fibers as necessary to create absorbent cellulosic structures with unique properties. The oxidized fibers are blended with wood based fibers that have been processed in any other manner such as chemical (sulfite, kraft), thermal, mechanical, or a combination of these techniques. The fibers could also be synthetic. When Northern Bleached Softwood Kraft (NBSK) pulp fibers are replaced with *cannabis* bast fibers, processed with the method described herein, the tensile strength of the absorbent cellulosic structures can be up to 100% greater. Rather than allowing the strength of the product to increase this significantly, only a portion of the NBSK pulp can be replaced and the tensile strength brought back to target by either decreasing the basis weight, decreasing overall refining, or substituting some of the remaining NBSK with weaker short fiber such as *eucalyptus* or *cannabis* hurd fiber.

Figure 7:
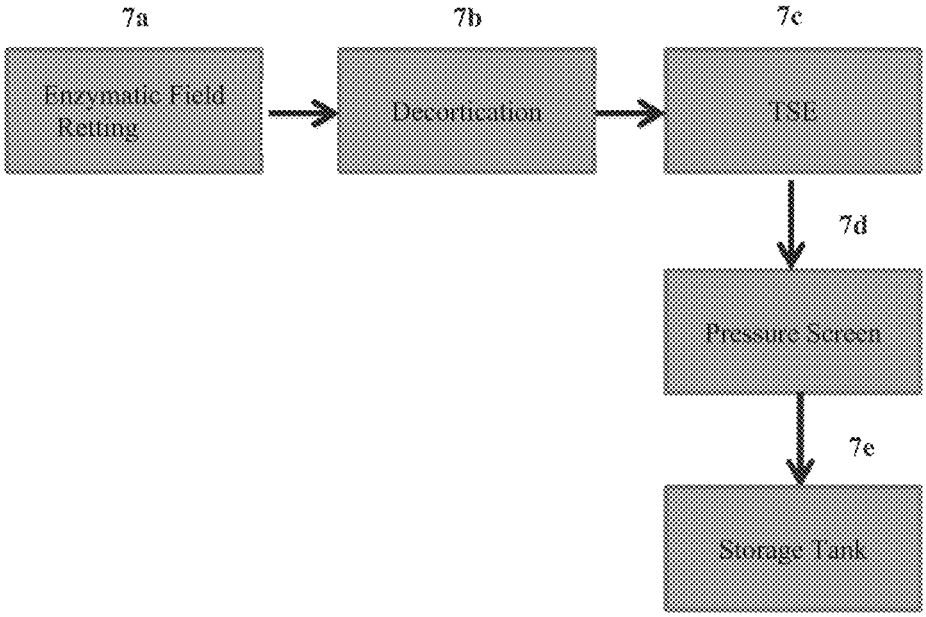
FIG. 7 illustrates *cannabis* fiber processing using a twin screw extruder according to an exemplary embodiment of the present invention.

FIG. 7 shows a fiber processing method according to a preferred exemplary embodiment of the present invention. In this process, decortication and (optionally) enzymatic field retting are performed as described above. However, rather than separate cutting and pre-treatment steps (including oxidation of the fibers through alkali/enzyme, or peroxide pretreatment), these steps may be combined together through the use of a twin screw extruder, as described in U.S. Pat. Nos. 4,088,528 and 4,983,256 and EP 0979895 A1, the contents of which are incorporated herein by reference in their entirety. Alternatively, a twin screw extruder is used only for the cutting step, and the pre-treatment step is performed separately. Although the process shown in FIG. 7 does not show a separate refining step, it should be appreciated that the process may include mechanical and/or thermo-mechanical refining of the fibers as described with reference to FIGS. 1-6.

Figure 10:
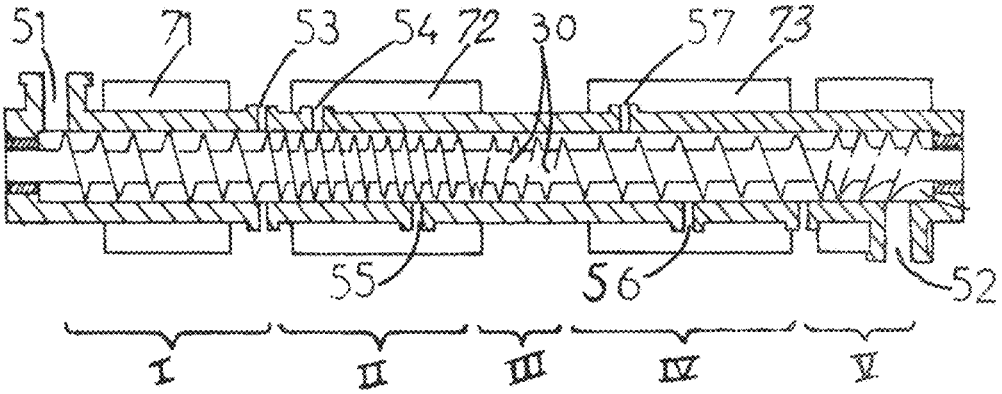
FIG. 10 shows a twin screw extruder usable in various exemplary embodiments of the present invention.

FIG. 10 illustrates a conventional twin screw extruder, generally designated by reference number 50, that may be used in exemplary embodiments of the present invention. The twin screw extruder 50 includes two parallel screws (only one screw 60 is shown in FIG. 10) driven to rotate about their axes within an elongate enclosure. The screws are provided with helical threads which engage one another as the screws rotate. The unprocessed fiber is provided to the twin screw extruder 50 through inlet opening 51 and the rotation of the screws causes advancement of the fibers towards outlet opening 52. The compression and shear forces within the twin screw extruder 50 result in grinding of the fibers. Further, as the fibers advance through the twin screw extruder 50, they may be subjected to heat and/or chemical treatment by heating elements 71, 72, 73 and through introduction of chemical reagents through openings 53, 54, 57. Waste may be collected through openings 55, 56 and either disposed of or recycled. By varying the temperature, chemical mixture and orientation of the threads along the screw lengths, various fiber treatment zones I, II, III, IV and V are created along the length of the twin screw extruder 50.

The fiber slurry produced as described with reference to FIGS. 1-7 is then supplied to a headbox to manufacture absorbent cellulosic structures on a wet laid asset such as any of the type used to produce tissue products such as conventional, ATMOS, NTT, ETAD, TAD, or UCTAD wet laid machines.

Each of the processing steps described above can be used as a stand-alone processing step or the steps can be done in any combination.

Produced tissue products include bath tissue, facial tissue or towel product containing *cannabis* bast or hurd fibers.

The bath or facial tissues can be 1, 2, or 3 ply products, preferably 2-ply products with a basis weight between 20 to 45 g/m$^2$, preferably 30 to 40 g/m$^2$, and more preferably 32 to 38 g/m$^2$.

The bath or facial tissue products have a caliper between 0.200 mm and 0.700 mm, preferably between 0.525 mm and 0.650 mm, and most preferably between 0.575 mm and 0.625 mm.

The bath or facial tissue products have an MD tensile between 190 N/m and 100 N/m, preferably between 170 and 120 N/M and a CD tensile of between 125 N/m and 25 N/m, preferably between 50 and 100 N/m.

The bath or facial tissue products have a ball burst between 100 and 300 grams force, preferably between 175 and 275 grams force.

The bath or facial tissue products have a lint value between 2 and 10, preferably between 3 to 6.

The bath or facial tissue products have an MD stretch between 10 and 30%, preferably between 20 and 30%.

The bath or facial tissue products have a TSA between 80 and 120, preferably between 90 and 110, a TS7 value between 5 and 15, preferably between 7 and 10, and a TS750 between 10 and 20, preferably between 10 and 15.

The towel product has a basis weight from 20 to 70 g/m$^2$, preferably 30 to 40 g/m$^2$, and more preferably 32 to 38 g/m$^2$.

The towel product has a caliper between 0.500 mm and 1.200 mm, preferably between 0.700 mm and 1.000 mm, and most preferably between 0.850 and 1.000 mm.

The towel product has an MD tensile between 300 N/m and 700 N/m, preferably between 300 and 500 N/m and a CD tensile of between 300 N/m and 700 N/m, preferably between 300 and 500 N/m.

The towel product has a ball burst between 500 and 1500 grams force, preferably between 800 and 1500 grams force.

The towel product has an MD stretch between 10 and 30%, preferably between 10 and 20%.

The towel product has an absorbency between 500-1000 gsm, preferably between 600-800 gsm.

The towel product has a TSA between 40 to 80, preferably between 50 and 70.

When the hurd fiber is not combined with the bast fiber and incorporated into an absorbent cellulosic structure, the hurd fiber can be combined with paper waste from a paper mill. Paper mill sludge has a significant water content (over 10%) and it is uneconomical to dry it sufficiently to be utilized as a fuel source. Therefore the sludge is usually disposed of as a waste product. The sludge is usually obtained by clarifying and dewatering the solids from the paper mill waste water stream. The solids obtained are usually over 95% cellulosic based fiber.

Hurd fiber can be combined with sludge removed from waste water to form a precursor material for conversion into fuel pellets. Paper dust may also be collected and combined with the hurd fiber prior to adding the sludge. The precursor material can then be sent through a fuel pelletizer to obtain a pellet with a moisture content below 10%, a requirement for most commercially sold fuel pellets.

Softness Testing

Softness of a 2-ply tissue web was determined using a Tissue Softness Analyzer (TSA), available from EMTECH Electronic GmbH of Leipzig, Germany. A punch was used to cut out three 100 cm$^2$ round samples from the web. One of the samples was loaded into the TSA, clamped into place, and the TPII algorithm was selected from the list of available softness testing algorithms displayed by the TSA. After inputting parameters for the sample, the TSA measurement program was run. The test process was repeated for the remaining samples and the results for all the samples were averaged. A TSA (overall softness), TS7 (bulk structure softness), and TS750 (surface structure softness) reading are obtained.

Ball Burst Testing

Ball Burst of a 2-ply tissue web was determined using a Tissue Softness Analyzer (TSA), available from EMTECH Electronic GmbH of Leipzig, Germany using a ball burst head and holder. A punch was used to cut out five 100 cm$^2$ round samples from the web. One of the samples was loaded into the TSA, with the embossed surface facing down, over the holder and held into place using the ring. The ball burst algorithm was selected from the list of available softness testing algorithms displayed by the TSA. The ball burst head was then pushed by the EMTECH through the sample until the web ruptured and the grams force required for the rupture to occur was calculated. The test process was repeated for the remaining samples and the results for all the samples were averaged.

Stretch & MD, CD, and Wet CD Tensile Strength Testing

An Instron 3343 tensile tester, manufactured by Instron of Norwood, Mass., with a 100N load cell and 25.4 mm rubber coated jaw faces was used for tensile strength measurement. Prior to measurement, the Instron 3343 tensile tester was calibrated. After calibration, 8 strips of 2-ply product, each one inch by four inches, were provided as samples for each test. For testing MD tensile strength, the strips are cut in the MD direction and for testing CD tensile strength, the strips are cut in the CD direction. One of the sample strips was placed in between the upper jaw faces and clamp, and then between the lower jaw faces and clamp with a gap of 2 inches between the clamps. A test was run on the sample strip to obtain tensile and stretch. The test procedure was repeated until all the samples were tested. The values obtained for the eight sample strips were averaged to determine the tensile strength of the tissue. When testing CD wet tensile, the strips are placed in an oven at 105° C. for 5 minutes and saturated with 75 microliters of deionized water immediately prior to pulling the sample.

Lint Testing

FIG. 9 describes a lint testing procedure using a Sutherland® 2000™ Rub tester, manufactured by Danilee Co., of San Antonia, Tex., USA.

Basis Weight

Using a dye and press, six 76.2 mm by 76.2 mm square samples were cut from a 2-ply product being careful to avoid any web perforations. The samples were placed in an oven at 105° C. for 5 minutes before being weighed on an analytical balance to the fourth decimal point. The weight of the sample in grams is divided by 0.0762 m$^2$ to determine the basis weight in grams/m$^2$.

Caliper Testing

A Thwing-Albert ProGage 100 Thickness Tester, manufactured by Thwing Albert of West Berlin, N.J., USA was used for the caliper test. Eight 100 mm×100 mm square samples were cut from a 2-ply product. The samples were then tested individually and the results were averaged to obtain a caliper result for the base sheet.

Absorbency Testing

An M/K GATS (Gravimetric Absorption Testing System), manufactured by M/K Systems, Inc., of Peabody, Mass., USA was to test the absorbency of the two-ply product.

In accordance with one exemplary embodiment, tissue made on a wet-laid asset with a three layer headbox is produced using the through air dried method. A Prolux 005 TAD fabric design supplied by Albany International Corp. of Rochester, N.H., USA, is utilized. The fabric is a 5 shed design with a warp pick sequence of 1,3,5,2,4, a 17.8 by 11.1 yarn/cm Mesh and Count, a 0.35 mm warp monofilament, a 0.50 mm weft monofilament, a 1.02 mm caliper, with a 640 cfm and a knuckle surface that is sanded to impart 27% contact area with the Yankee dryer. The flow to each layer of the headbox is about 33% of the total sheet. The three layers of the finished tissue from top to bottom are labeled as air, core and dry. The air layer is the outer layer that is placed on the TAD fabric, the dry layer is the outer layer that is closest to the surface of the Yankee dryer and the core is the center section of the tissue. The tissue is produced with 45% *eucalyptus,* 55% NBSK fiber in the air layer; 50% *eucalyptus,* 25% NBSK, and 25% bast *cannabis* fiber in the core layer; and 100% *eucalyptus* fiber in the dry layer.

The *cannabis* bast fiber is prepared as shown in FIG. 1 by cutting decorticated bast fibers to 6 mm length, beating the fiber at 4% consistency in a pulper using 190° F. water for 30 minutes. The slurry is then pumped to a holding tank with steam injection to hold the slurry temperature to 190° F. before being pumped to a conical refiner model RGP 76 CD supplied by Valmet Corporation of Espoo, Finland.

The bast fibers are oxidized using one of two methods. Using the standard alkaline control process, the pH of the slurry is controlled with sodium hydroxide injection to the suction of the pump supplying the refiner to a pH of 8. Alternatively, the pH of the slurry is controlled with sodium hydroxide injection to the suction of the pump supplying the refiner to a pH within a range of 7-12, preferably within a range of 7-10, and more preferably the pH is 8. Hydrogen peroxide is added after sodium hydroxide addition near the inlet to the refiner and controlled by using ORP (oxidation reduction potential) meter to control to an ORP set-point between +350 and +500 mV at the injection point of $H_2O_2$ (before refining) and target +100 to +200 mV after refining to ensure depletion of peroxide activity.

In the case where sodium hydroxide is added, hydrogen peroxide mixed with a metal catalyst such as copper (1 part catalyst to 100 parts hydrogen peroxide) is added after sodium hydroxide addition near the inlet to the refiner and controlled by an ORP (oxidation reduction potential) probe at the discharge of the refiner to a target range of +100 to +200 mV.

Using the acid control process, the pH of the slurry is controlled with urea sulfate injection to the suction of the pump supplying the refiner to a pH within a range of 6-7, preferably within a range of 5-7 and more preferably the pH is 5.

In the case where urea sulfate is added, hydrogen peroxide mixed with a metal catalyst such as copper (1 part catalyst to 100 parts hydrogen peroxide) is added after urea sulfate addition near the inlet to the refiner where the oxidation reduction potential of the fiber slurry prior to the mechanical refiner is controlled to between +300 and +500 my, preferably between +350 and +450 mV, or where the oxidation reduction potential of the fiber slurry after the mechanical refiner is controlled to between −100 mV and −200 mV.

The refining energy imparted to the fiber slurry is 80 kwh/ton. The bast fiber is then added to the core layer blend chest where it is mixed with the NBSK, processed separately, before being pumped and diluted through a fan pump to feed the middle layer of the 3-layer headbox.

The tissue, according to the first exemplary embodiment, is produced with chemistry described in U.S. patent application Ser. No. 13/837,685, the contents of which are incorporated herein by reference, with addition of a temporary wet strength additive, Hercobond 1194 (supplied by Ashland of Wilmington, Del., USA) to the air layer, a dry strength additive, Redibond 2038 (supplied by Corn Products, of Bridgewater, N.J., USA) split 75% to the air layer, 25% to the dry layer, and a softener/debonder, T526 (supplied by EKA Chemicals Inc., of Marietta, Ga., USA) added in combination to the core layer. The T526 is a softener/debonder combination with a quaternary amine concentration below 20%.

The tissue is then plied together to create a rolled 2-ply sanitary tissue product with 190 sheets, a roll firmness of 6.5, a roll diameter of 121 mm, with sheets having a length and width of 4.0 inches. The 2-ply tissue product further has the following product attributes: basis weight of 37 g/m$^2$, caliper of 0.610 mm, MD tensile of 150 N/m, CD tensile of 90 N/m, a ball burst of 240 grams force, a lint value of 5.5, an MD stretch of 18%, a CD stretch of 6%, a CD wet tensile of 14 N/m, a TSA of 93, a TS7 of 8.5, and a TS750 of 14.

Figure 2:
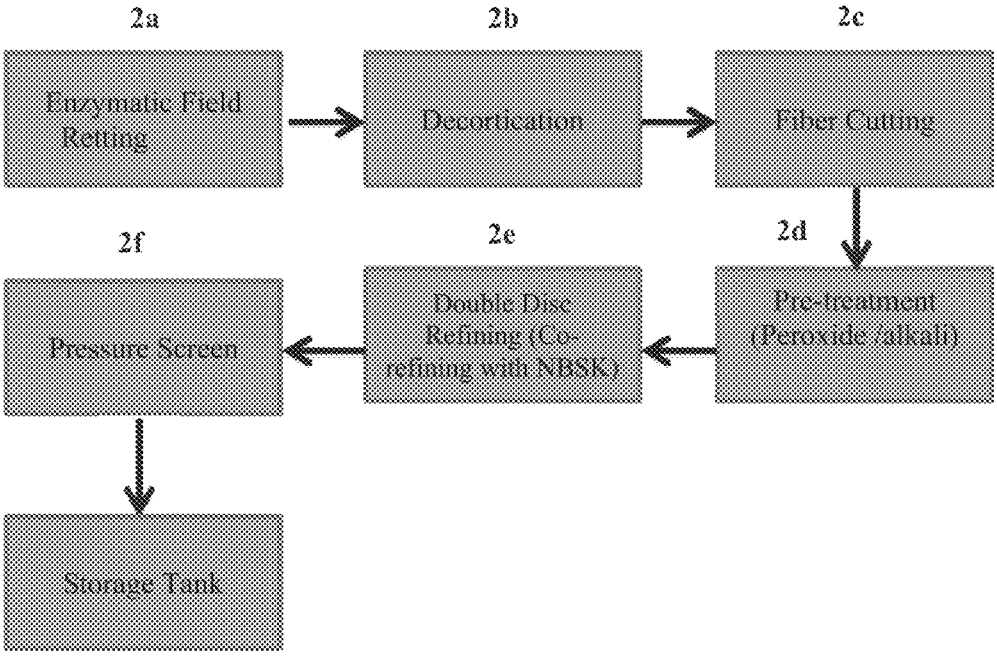
FIG. 2 illustrates *cannabis* fiber processing via enzymatic field retting and co- and refining with NBSK fibers with alkali and peroxide pretreatment according to an exemplary embodiment of the present invention.
Figure 3:
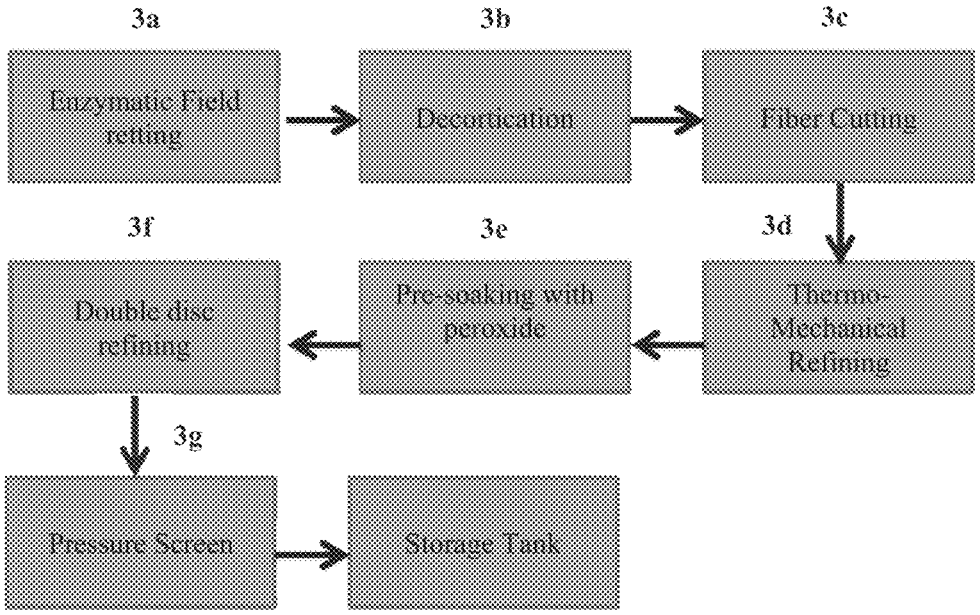
FIG. 3 illustrates *cannabis* fiber processing via enzymatic field retting and two stage refining in the presence of peroxide and steam according to an exemplary embodiment of the present invention.

In a second exemplary embodiment, the product is made in the same manner as the first exemplary embodiment, resulting in the same physical properties of the 2-ply tissue roll. The only exception being that the *cannabis* bast and NBSK fiber are processed through the refiner together with 40 kwh/ton energy intensity as shown in FIG. 2. Since processed together, the slurry mixture is roughly 25% bast fiber, 75% NBSK which is then pumped to the core and air layer blend chest. The final fiber distribution is 100% *eucalyptus* to the Yankee layer, with the air and core layer being 47.5% *eucalyptus,* 12.5% bast, and 40% NBSK.

In another exemplary embodiment, the product is made in the same manner as the first exemplary embodiment except the Yankee layer fiber content is 90% *eucalyptus* and 10% *cannabis* hurd fiber. The hurd fiber is processed separately in the manner described in the first exemplary embodiment but with an energy intensity of 30 kwh/ton provided by a separate refiner.

In another exemplary embodiment, paper towel made on a wet-laid asset with a three layer headbox is produced using the through air dried method. A TAD fabric design described in U.S. Pat. No. 5,832,962 and supplied by Albany International Corp. of Rochester, N.H., USA was utilized. The fabric is a 13 shed design with 12.0 yarn/cm Mesh and Count, a 0.35 mm warp monofilament, a 0.50 mm weft monofilament, a 1.29 mm caliper, with a 670 cfm and a knuckle surface that is sanded to impart 12% contact area with the Yankee dryer. The flow to each layer of the headbox is about 33% of the total sheet. The three layers of the finished tissue from top to bottom are labeled as air, core and dry. The air layer is the outer layer that is placed on the TAD fabric, the dry layer is the outer layer that is closest to the surface of the Yankee dryer and the core is the center section of the tissue. The tissue is produced with 20% *eucalyptus,* 15% *cannabis* bast fiber, and 65% NBSK. The Yankee layer fiber is 50% *eucalyptus,* 50% NBSK. Polyamine polyamide-epichlorohydrin resin at 10 kg/ton (dry basis) and 4 kg/ton (dry basis) of carboxymethyl cellulose are added to each of the three layers to generate permanent wet strength.

The *cannabis* fiber is prepared using the process described in FIG. 4. Following the decortication step, the decorticated bast fibers are cut to 6 mm length, beating the fiber at 4% consistency in a pulper at a temperature of 190° F. for 30 minutes. The slurry is then pumped to a holding tank with steam injection to hold the slurry temperature to 190° F. before being pumped to a conical refiner model RGP 76 CD supplied by Valmet Corporation of Espoo, Finland.

The bast fibers are oxidized using one of two methods. Using the standard alkaline control process, the pH of the slurry is controlled with caustic injection to the suction of the pump supplying the refiner. Hydrogen peroxide is added after caustic addition near the inlet to the refiner and controlled by using ORP (oxidation reduction potential) meter to control to an ORP set-point between +350 and +500 mV at the injection point of $H_2O_2$ (before refiner) and target +100 to +200 mV after refining to ensure depletion of peroxide activity.

Using the acid control process, the pH of the slurry is controlled with sulfuric acid injection to the suction of the pump supplying the refiner. Hydrogen peroxide and a metal catalyst such as iron (1 part catalyst to 100 parts hydrogen peroxide) is added after acid addition near the inlet to the refiner where the oxidation reduction potential of the fiber slurry prior to the mechanical refiner is controlled to between +300 and +500 mV, preferably between +350 and +450 mV, or where the oxidation reduction potential of the fiber slurry after the mechanical refiner is controlled to between −100 mV and −200 mV.

The refining energy imparted to the fiber slurry is 80 kwh/ton. The bast fiber is then added to the core and air layer blend chests where it is mixed with the NBSK and *eucalyptus*, processed separately, before being pumped and diluted through fan pumps to feed two layers of the 3-layer headbox.

The towel is then plied together to create a rolled 2-ply product with 142 sheets, a roll diameter of 142 mm, with sheets having a length of 6.0 inches and a width of 11 inches. The 2-ply tissue product further has the following product attributes: basis weight of 39 g/m$^2$, caliper of 0.850 mm, MD tensile of 385 N/m, CD tensile of 365 N/m, a ball burst of 820 grams force, an MD stretch of 18%, a CD stretch of 6%, a CD wet tensile of 105 N/m, an absorbency of 750 gsm, and a TSA of 53.

The invention claimed is:

1. A base sheet that forms a single ply of a bath tissue, facial tissue or towel product, the base sheet comprising at least three layers, at least one of the layers comprising northern bleached softwood kraft pulp fiber and *cannabis* fiber that contains at least 50% by weight of original amount of pectin contained in the *cannabis* fiber prior to processing.

2. The base sheet of claim 1, wherein two base sheets are plied together to form a two ply bath or facial tissue product.

3. The base sheet of claim 2, wherein the bath or facial tissue product has a basis weight between 20 to 45 g/m$^2$.

4. The base sheet of claim 3, wherein the bath or facial tissue product has a basis weight of 32 to 38 g/m$^2$.

5. The base sheet of claim 2, wherein the bath or facial tissue product has a caliper of 0.200 mm to 0.700 mm.

6. The base sheet of claim 5, wherein the bath or facial tissue product has a caliper of 0.525 to 0.650 mm.

7. The base sheet of claim 5, wherein the bath or facial tissue product has a caliper of 0.575 mm to 0.625 mm.

8. The base sheet of claim 2, wherein the bath or facial tissue product has a machine direction tensile strength of 100 N/m to 190 N/m.

9. The base sheet of claim 8, wherein the bath or facial tissue product has a machine direction tensile strength of 120 N/m to 170 N/m.

10. The base sheet of claim 2, wherein the bath or facial tissue product has a cross direction tensile strength of 25 N/m to 125 N/m.

11. The base sheet of claim 10, wherein the bath or facial tissue product has a cross direction tensile strength of 50 N/m to 100 N/m.

12. The base sheet of claim 2, wherein the bath or facial tissue product has a ball burst of 100 to 300 grams force.

13. The base sheet of claim 12, wherein the bath or facial tissue product has a ball burst of 175 to 275 grams force.

14. The base sheet of claim 2, wherein the bath or facial tissue product has a lint value of 2 to 10.

15. The base sheet of claim 2, wherein the bath or facial tissue product has a lint value of 3 to 6.

16. The base sheet of claim 2, wherein the bath or facial tissue product has a machine direction stretch of 10% to 30%.

17. The base sheet of claim 16, wherein the bath or facial tissue product has a machine direction stretch of 20% to 30%.

18. The base sheet of claim 2, wherein the bath or facial tissue product has a TSA value of 80 to 120.

19. The base sheet of claim 18, wherein the bath or facial tissue product has a TSA value of 90 to 110.

20. The base sheet of claim 2, wherein the bath or facial tissue product has a TS7 value of 5 to 15.

21. The base sheet of claim 20, wherein the bath or facial tissue product has a TS7 value of 7 to 10.

22. The base sheet of claim 2, wherein the bath or facial tissue product has a TS750 value of 10 to 20.

23. The base sheet of claim 22, wherein the bath or facial tissue product has a TS750 value of 10 to 15.

24. The base sheet of claim 1, wherein two base sheets are plied together to form a two ply towel product.

25. The base sheet of claim 24, wherein the towel product has a basis weight of 20 g/m$^2$ to 70 g/m$^2$.

26. The base sheet of claim 25, wherein the towel product has a basis weight of 30 g/m$^2$ to 40 g/m$^2$.

27. The base sheet of claim 25, wherein the towel product has a basis weight of 32 g/m$^2$ to 38 g/m$^2$.

28. The base sheet of claim 24, wherein the towel product has a caliper of 0.500 mm to 1.200 mm.

29. The base sheet of claim 28, wherein the towel product has a caliper of 0.700 mm to 1.000 mm.

30. The base sheet of claim 28, wherein the towel product has a caliper of 0.850 mm to 1.000 mm.

31. The base sheet of claim 24, wherein the towel product has a machine direction tensile strength of 300 N/m to 700 N/m.

32. The base sheet of claim 31, wherein the towel product has a machine direction tensile strength of 300 N/m to 500 N/m.

33. The base sheet of claim 24, wherein the towel product has a cross direction tensile strength of 300 N/m to 700 N/m.

34. The base sheet of claim 33, wherein the towel product has a cross direction tensile strength of 300 N/m to 500 N/m.

35. The base sheet of claim 24, wherein the towel product has a ball burst value of 500 grams force to 1500 grams force.

36. The base sheet of claim 35, wherein the towel product has a ball bust value of 800 grams force to 1500 grams force.

37. The base sheet of claim 24, wherein the towel product has a machine direction stretch of 10% to 30%.

38. The base sheet of claim 37, wherein the towel product has a machine direction stretch of 10% to 20%.

39. The base sheet of claim 24, wherein the towel product has an absorbency of 500 gsm to 1000 gsm.

40. The base sheet of claim 39, wherein the towel product has an absorbency of 600 gsm to 800 gsm.

41. The base sheet of claim 24, wherein the towel product has a TSA value of 40 to 80.

42. The base sheet of claim 41, wherein the towel product has a TSA value of 50 to 70.

43. The base sheet of claim 1, wherein two or more base sheets are plied together to form a multi-ply tissue or towel product.

* * * * *